United States Patent [19]

Kolbe et al.

[11] 3,979,544

[45] Sept. 7, 1976

[54] FLOCK OF SYNTHETIC FIBERS FOR ELECTROSTATIC FLOCKING

[75] Inventors: Joachim Kolbe, Leverkusen; Otto Schneider, Cologne; Ernst Gutschik; Dieter Brokmeier, both of Dormagen, all of Germany

[73] Assignee: Bayer Aktiengesellschaft, Leverkusen, Germany

[22] Filed: June 9, 1975

[21] Appl. No.: 584,846

[30] Foreign Application Priority Data

July 2, 1974 Germany ..... 2431847
Nov. 28, 1974 Germany ..... 2456309

[52] U.S. Cl. ..... 428/361; 428/359; 428/375; 428/393; 428/394; 428/395

[51] Int. Cl.[2] ..... B32B 9/00; B32B 27/00; D02G 3/00

[58] Field of Search ..... 428/375, 392, 359, 393, 428/361, 394, 395; 8/99, 98, 94.25, 65; 106/286

[56] References Cited

UNITED STATES PATENTS

| | | | |
|---|---|---|---|
| 2,819,754 | 1/1958 | Feigley | 428/280 |
| 2,987,369 | 6/1961 | Linnell | 8/94.25 |
| 3,179,483 | 4/1965 | Millson et al. | 8/98 X |
| 3,511,704 | 5/1970 | Wyss et al. | 428/361 |

*Primary Examiner*—Lorraine T. Kendell
*Attorney, Agent, or Firm*—Plumley & Tyner

[57] ABSTRACT

Flock of synthetic fibers, especially of polyamide fibers, suitable for electrostatic flocking, and containing a certain amount of mineral tanning agents.

5 Claims, No Drawings

FLOCK OF SYNTHETIC FIBERS FOR ELECTROSTATIC FLOCKING

This invention relates to an improved flock of synthetic fibres, more especially of polyamide fibres containing mineral tanning agents, such as chromium, aluminium or zirconium salts, or mixtures thereof, which is eminently suitable for use in electrostatic flocking.

Electrostatic flocking is a widely used process, in which short fibres, having a maximum length of up to about 15 mm, but generally having a length of up to 3 mm, are applied in high-voltage electrostatic field of a substrate coated with special adhesives to produce a velours finish.

The principle upon which flocking is based is that, in the electrostatic field, the fibres are charged either by mutual contact or by electrostatic induction, as a result of which they are given a polarity which aligns the fibres parallel to the lines of force of the electrical field.

Under the effect of the attractive, opposite charges, the fibres are simultaneously attracted by the opposite pole and are thus anchored in the layer of adhesive coating the substrate. However, after the fibres have been anchored in the layer of adhesive, the charge applied has to be dissipated sufficiently quickly, because the charge present in the fibres itself induces an electrical field and, hence, prevents the formation of a uniformly compact surface.

Synthetic fibres are known to have poor conductivity. As a result of their poor conductivity, they cannot readily be used for electrostatic flocking because their lack of conductivity gives rise to certain deficiencies.

Fibres are electrostatically charged when mechanically mixed in the metering units of a flocking machine, and, as a result, "stick" to one another and to the edges of the metering system. This results in irregular metering, difficult cleaning and, in some cases, even in explosions after spontaneous discharges. In addition, the flock particles only "spring up" very slowly, if at all, in the electrical field. Finally, the surface finish obtained is extremely irregular because of the electrical interference fields.

Several proposals have already been made with a view to overcoming these difficulties. For example, it has already been proposed to increase the relative humidity of the surrounding atmosphere to such an extent that the conductivity of the fibres is high enough to give a better result. However, in order to obtain satisfactory results, the processing of non-finished synthetic fibres required relative humidity levels of, for example, above 80% in the case of polyamides and above 90% in the case of polyesters. At air humidity levels as high as these, not only is it extremely difficult to build up an electrostatic high-voltage field but also considerable corrosion problems arise. Accordingly, antielectrostatic preparations were developed, guaranteeing adequate fibre conductivity levels after being applied to the flock, despite reduced relative air humidity. Preparations of this kind, based on ion-forming or at least polarised substances, are described in various patent specifications (U.S. Patent Specification 2,917,401; French Patent Specifications 1,257,894 and 1,157,657).

Although preparations of this kind enabled adequate fibre conductivity levels to be obtained, their tackiness proved to be a disadvantage insofar as it caused the fibres to stick together, thus preventing them from flowing freely and uniformly through the sieve forming part of the flocking machine.

According to British Patent Specification 686,101, fibres can be prevented from sticking together by treating them with aqueous dispersions of finely divided chalk, magnesia or silica. According to German Patent Specification 1,040,497, however, the ability of fibres treated in this way to spring up in the electrostatic field is unsatisfactory.

According to Swiss Patent Specification 426,723, all these disadvantages can be avoided by treating flocks of manmade fibres with tanning and potassium antimonyl tartrate. This treatment is said to provide a flock having a high conductivity and an outstanding ability to spring up in an electrostatic field. According to the same patent, it is possible to obtain an improvement in properties, especially slidability and free flow, by treating the fibres, following their treatment with tannin and potassium antimonyl tartrate (tartar emetic), with an aqueous solution of an anion-active preparation optionally containing water-soluble alkali salts.

Unfortunately, this process is also attended by several disadvantages. For example, it is not possible to carry out the treatment with potassium antimonyl tartrate and the subsequent treatment with anion-active compounds in a single bath, because the flock can be expected to undergo heavy discoloration. In the process disclosed in the Swiss Patent Specification, the flock has to be additionally spin-dried for 10 minutes in a separate stage preceding the aftertreatment which complicates the process. In addition, it is extremely difficult to obtain a pure white flock.

It is an object of this invention to avoid the disadvantages referred to above. This object is accomplished by a flock of synthetic fibres for electrostatic flocking, containing mineral tanning agents such as Cr salts, Al salts and, in particular, Zr salts or mixtures thereof. The tanning agent content of the flock is preferably from 0.01 to 2% by weight.

In the context of this application "a flock containing mineral tanning agents" means that the fibers of the flock contain the tanning agents adsorbed to the surface of said fibers.

The flock is obtained by treating an untreated flock, for example of nylon 6 or 6.6, with an aqueous solution containing from 1 to 10 g/l of the mineral tanning agents used in accordance with the invention at temperatures from the freezing point of the aqueous solution to 100°C, the treatment optionally being accompanied by finishing in the same bath or in a separate bath, optionally in the presence of 1 to 30% by weight, based on the flock, of water-soluble alkali salts, with a finishing preparation, in which from 0.05 to 10% by weight of finishing preparation, based on the flock, are present in the solution.

Suitable mineral tanning agents are water-soluble, preferably basic or hydrolysable salts of chromium aluminium or zirconium, of the type which may be used, for example, for retanning and tanning, and also as an auxiliary in the dyeing of leather and which are described in Winnacker-Kuchler "Chemische Technologie", Vol. IV, 1960, pages 657 et seq. Examples oof zirconium-containing products of this kind are also described in German Patent Specification 1,282,629. A mineral tanning agent which is eminently suitable for producing the flock according to the invention and which may be obtained in accordance with German Patent Specification 1,282,629, has approximately the following composition: $Zr(OH)_2SO_4 + SiO_2 . H_2O + Na_2SO_4$.

In addition to the above-mentioned constituents, another eminently suitable mineral tanning agent contains additives which have a tanning effect, such as aluminium sulphate and basic chromium sulphate.

The flock may consist of any synthetic fibres, for example viscose, polyacrylonitrile, although it preferably consists of polyester or polyamide fibres, such as nylon-6 or nylon 6.6.

Suitable finishing preparations are anion-active or non-ionic finishing preparations, such as for example (in the case of anion-active compounds)

$$C_{12}H_{25}OSO_3Na,\ C_{18}H_{37}OSO_3Na,\ C_{12}H_{25}O(CH_2CH_2O)_4SO_3Na,$$

$$[C_{18}H_{35}O(CH_2CH_2O)_5]_2\underset{\underset{O}{\downarrow}}{P}ONa,$$

sulphonation products of vegetable and animal oils such as, for example, the sulphonation products of olive oil, castor oil, sperm oil or beef tallow, and (in the case of non-ionic compounds) for example compounds corresponding to the formulae $$C_{18}H_{37}CON(CH_2CH_2OH)_2,\quad C_{18}H_{37}COO(CH_2CH_2O)_6H,$$

or $$C_{18}H_{37}O(CH_2CH_2O)_{20}H.$$

It is preferred to use anion-active compounds, for example the sulphates of relatively high molecular weight alcohols.

The flock is treated with the mineral tanning agents at acidic pH-values, preferably at pH-values in the range from 1 to 5. The treatment may be carried out at temperatures in the range from 30° to 100°C and preferably at temperatures in the range from 50° to 80°C, although it may also be carried out at temperatures between the freezing point and 30°C. It may be of advantage to apply a finish using standard commercial-grade finishing agents of anion-active or non-ionic structure. The finishing treatment may be carried out either in the same bath, for example at the same temperature or at a lower temperature and at the same pH-value ("one-bath"), or subsequently in separate baths at different temperatures from the first treatment and at different pH-values ("separate bath").

The particular advantage of the process according to the invention is that treatment with the mineral tanning agents and aftertreatment with the finishing preparations of the kind described above may be carried out in one solution. Another advantage of the process according to the invention is that it is possible, simply by treating the flock with the mineral tanning agents, preferably compounds containing zirconium, i.e. without the finishing treatment, to obtain a very white flock having outstanding free flow properties and high conductivity which is suitable for use in, for example, electrostatic flocking. By adding small quantities of the finishing preparations described above, preferably anion-active finishing preparations, the properties of the flock may be even further influenced in the required manner. In addition, the feel of flocked articles may be favourably influenced by suitably selecting the finishing preparations. In particular, it is possible by using anion-active finishing preparations to obtain a flock having a very hard, dry feel which is desirable for numerous applications.

The treatment with finishing preparations may also be carried out in the presence of water-soluble salts of alkali metals. By suitably adjusting the concentration, the feel of the flock may also be influenced in the required manner in this way.

Treatment of the synthetic fibre flock in accordance with the invention, in which both the mineral tanning agents and also, to some extent, the finishing preparations are absorbed by the fibres which constitute the flock, produces a permanent increase in electrical conductivity, permanent and outstanding free flow properties and a high degree of flock "springability" superior to that of all conventional finishing treatments. In cases where zirconium and/or aluminium tanning agents are used, the flock obtained does not undergo any change in its natural colour, whereas in cases where mineral tanning agents additionally containing chromium compounds are used, the flock undergoes only a very slight change in its natural colour. The favourable properties remain unchanged even when the flock is stored under various climatic conditions, even at elevated temperatures.

The process according to the invention may be carried out, for example, as follows:

The flock is introduced at 50° to 80°C into an aqueous solution, containing 1 to 10 g/l of a water-soluble salt of a mineral tanning agent, for example a basic zirconium sulphate, and stirred for 10 to 30 minutes. The aqueous solution has a pH-value in the range from 1 to 4. The ratio of flock to aqueous solution is from 1 : 8 to 1 : 25. The finishing treatment is then carried out over a period of 10 to 30 minutes at temperatures in the range from 40° to 80°C and at pH-values in the range from 1 to 7, using 0.05 to 10% by weight, preferably 1 to 5% by weight, based on the weight of the flock, of anion-active or non-ionic finishing preparations. Finishing is preferably carried out with 1 to 5% by weight of anion-active finishing preparations. From 1 to 30% by weight of water-soluble alkali salts may optionally be added for the final finishing treatment. After the finishing treatment is completed, the flock is filtered off from the solution and spin dried for 5 to 10 minutes to a residual moisture content of from 10 to 20% by weight. After spin drying, the flock is dried at temperatures in the range from 20° to 80°C. Drying is preferably carried out in a recirculating-air dryer, cyclone dryer, drum dryer or similar dryers, although it may also be carried out in shelf dryers.

The flock thus prepared for electrostatic flocking may advantageously be stored for a while in a room having between 50 and 70% relative air humidity before it is used. The flock according to the invention may then be applied in known manner to adhesive-coated substrates in an electrostatic high-voltage field.

The following examples are to further illustrate the invention without limiting it.

EXAMPLE 1

50 g of flock of nylon-6.6 fibres having a length of 1 mm and a denier of 3.3 dtex are introduced into a solution preheated to 80°C, of 5 g of a basic zirconium sulphate of the composition $Zr(OH)_2SO_4 + SiO_2 . H_2O + Na_2SO_4$ (prepared in accordance with Example 1 of German Patent Specification 1,282,629) in 1 liter of water, followed by virgorous stirring for 20 minutes at the aforementioned temperature. The flock is then filtered off from the aqueous solution, spin-dried for 5 minutes at 1000 rpm. in a spin dryer and then dried for 20 minutes at 40°C in a cyclone dryer. The flock has a surface resistance of $3 \times 10^8$ ohms (measured in accordance with DIN 54345 at 20°C, 65% relative humidity). The flock shows outstanding free flow properties and good "springability" in a high-voltage electrical field.

EXAMPLE 2

50 g of flock of nylon-6.6 fibres having a length of 1 mm and a denier of 3.3 dtex are introduced into a solution, preheated to 80°C, of 4 g of a basic zirconium sulphate having the same composition as in Example 1, but additionally containing aluminium sulphate and basic chromium sulphate, in 750 ml of water, followed by vigorous stirring for 20 minutes at the aforementioned temperature. The suspension is then cooled to 50°C by the addition of 250 g of water. An aqueous emulsion of 5 g of the sodium salt of stearyl alcohol sulphate in 50 g of water is then added to the aqueous suspension, after which the mixture is stirred for 20 minutes. The flock is then filtered off from the aqueous solution, spin-dried for 5 minutes at 1000 rpm. in a spin dryer and dried for 20 minutes at 40°C in a cyclone dryer. The flock has a surface resistance of $5 \times 10^7$ ohm (measured in accordance with DIN 54345 at 20°C, 50% relative air humidity). The flock shows outstanding free flow properties and retains its springability, even after prolonged mechanical stressing, for example by repeated exposure over a prolonged period to high-voltage electrical field.

EXAMPLE 3

50 g of flock of nylon-6 fibres having a length of 1 mm and a denier of 3.3 dtex are introduced into a solution, preheated to 80°C, of 4 g of a basic zirconium sulphate prepared in accordance with Example 1 in 750 ml of water, followed by vigorous stirring for 20 minutes at the aforementioned temperature. The suspension is then cooled to 50°C by the addition of 250 g of water. An aqueous emulsion of 5 g of the sodium salt of stearyl alcohol sulphate and 10 g of sodium chloride in 50 g of water is then added to the aqueous suspension, and the mixture stirred for 20 minutes. The flock is then filtered off from the aqueous solution, spin-dried for 5 minutes at 1000 rpm. in a spin dryer and dried for 20 minutes at 40°C in a cyclone dryer. The flock has a surface resistance of $3 \times 10^7$ ohms (measured in accordance with DIN 54345 at 20°C/50% relative humidity). The flock shows outstanding free flow properties and retains its springability, even after prolonged mechanical stressing, for example by repeated exposure over a prolonged period to high-voltage electrical field.

EXAMPLE 4

50 g of flock of nylon-6 having a length of 0.75 mm and a denier of 1.6 dtex are introduced into a solution, preheated to 60°C, of 3 g of a basic zirconium sulphate prepared in accordance with Example 1 in 750 g of water, followed by vigorous stirring of the resulting suspension for 20 minutes at the aforementioned temperature. An aqueous emulsion of 4 g of the sodium salt of lauryl alcohol sulphate and 7 g of sodium chloride in 50 ml of water is then added to the suspension at the same temperature. After stirring for another 20 minutes, the flock is filtered off from the aqueous solution, spin-dried for 5 minutes at 1000 rpm. in a spin dryer and dried for 20 minutes at 40°C in a cyclone dryer. The flock has a surface resistance of $4 \times 10^7$ ohms (measured in accordance with DIN 54345 at 20°C/65% relative air humidity), and shows outstanding free flow properties. The flock shows excellent springability in high-voltage electrostatic field.

EXAMPLE 5

50 g of flock of nylon-6 having a length of 2 mm and a denier of 22 dtex are introduced into a solution, preheated to 80°C, of 5 g of the basic zirconium sulphate used in Example 1 in 750 ml of water, followed by stirring for 20 minutes at the aforementioned temperature. A solution of 7 g of the sodium salt of lauryl alcohol sulphate and 10 g of sodium chloride in 250 ml of water is then added to the aqueous suspension. After the suspension has been stirred for another 20 minutes at the aforementioned temperature, the flock is filtered off from the aqueous solution and dried in the same way as described above. After conditioning, the flock has a surface resistance of $2 \times 10^7$ ohms and shows outstanding free flow properties. It retains its good springability in an electrostatic field, even after prolonged storage.

EXAMPLE 6

50 g of flock of nylon-6 having a length of 2 mm and a denier of 20 dtex are introduced into a solution, preheated to 60°C, of 4 g of the basic zirconium sulphate used in Example 1 in 700 ml of water, followed by stirring for 20 minutes at the aforementioned temperature. An aqueous solution of 2 g of a non-ionic finish (Persoftal FN, a product of Bayer AG) and 10 g of sodium chloride in 50 g of water is then added to the suspension. After stirring for another 20 minutes, the flock is filtered off from the aqueous solution. A flock having a surface resistance of $6 \times 10^7$ ohms is obtained after spin-drying and drying in the same way as in Example 1. The flock shows favourable free flow properties and excellent springability in an electrostatic field.

EXAMPLE 7

50 g of flock of nylon-6 having a length of 1 mm and a denier of 3.3 dtex are introduced into a solution, preheated to 80°C, of 3 g of the basic zirconium sulphate described in Example 1 in 750 ml of water, followed by stirring for 20 minutes at the aforementioned temperature. The aqueous suspension is then cooled to 50°C by the addition of 250 ml of water. Following the addition of an aqueous solution of 4 g of a standard commercial-grade non-ionic finish (Bayer's Persoftal FN) and 10 g of sodium chloride, the mixture is stirred for 30 minutes at the aforementioned temperature. The flock is then filtered off from the aqueous solution, spin-dried for 5 minutes as in Example 1 and then dried out in the same way as described above. After conditioning, the flock has a surface resistance of $5 \times 10^7$ ohms and shows outstanding free flow properties.

EXAMPLE 8

50 g of flock of nylon-6 having a length of 1 mm and a denier of 3.3 dtex are introduced into a solution, preheated to 80°C, of 2 g of $ZrOCl_2$ in 1000 ml of water, followed by stirring for 20 minutes at the aforementioned temperature. The suspension is then cooled to 30°C, followed by the addition with stirring of a solution of 5 g of the sodium salt of lauryl alcohol $(CH_2CH_2O)_4$-sulphate and 10 g of sodium chloride. The suspension is then stirred for another 20 minutes at the aforementioned temperature, after which the flock is filtered off from the aqueous solution and dried in the same way as described above. After conditioning, the flock has a surface resistance of $3 \times 10^7$ ohms and shows outstanding free flow properties.

EXAMPLE 9

50 g of flock of viscose having a length of 1 mm and a denier of 5.2 dtex are introduced into a solution, preheated to 80°C, of 5 g of the zirconium sulphate used in Example 1 in 350 ml of water, followed by stirring for 20 minutes at the aforementioned temperature. A solution of 7 g of lauryl alcohol sulphate and 10 g of sodium chloride in 250 ml of water is added to the aqueous suspension. The suspension is then stirred for another 20 minutes at the aforementioned temperature, after which the flock is filtered off from the aqueous solution and dried in the same way as described above. After conditioning, the flock has a surface resistance of $6 \times 10^7$ ohms and shows outstanding free flow properties.

EXAMPLE 10

50 g of flock of nylon-6.6 fibres having a length of 1 mm and denier of 3.3 dtex are introduced into a solution, preheated to 20°C, of 5 g of a basic zirconium sulphate of the composition $Zr(OH)_2SO_4 + SiO_2.H_2O + Na_2SO_4$ (prepared in accordance with Example 1 of DT-PS 1,282,629) in 0.75 liter of water, followed by vigorous stirring for 20 minutes at the aforementioned temperature. The flock is then filtered off from the aqueous solution, spin-dried for 5 minutes at 1000rpm. in a spin dryer and then dried for 20 minutes at 80°C in a cyclone dryer. The flock has a surface resistance of $2 \times 10^8$ ohms (measured in accordance with DIN 54345 at 20°C/65% relative humidity). The flock shows outstanding free flow properties and excellent springability in a high-voltage field.

EXAMPLE 11

50 g of flock of nylon-6.6 fibres having a length of 1 mm and a denier of 3.3 dtex are introduced into a solution of 3 g of $Zr(SO_4)_2 . 4 H_2O$ and 10 g of sodium chloride in 750 ml of water and stirred for 15 minutes at a temperature of 18°C. The flock is then filtered off from the aqueous solution, spin-dried for 5 minutes at 1000 rpm. in a spin dryer and dried out for 20 minutes at 90°C in a cyclone dryer. The flock has a surface resistance of $7 \times 10^6$ ohms (measured in accordance with DIN 54345 at 20°C/65% relative humidity). The flock shows outstanding free flow properties and retains its springability, even after prolonged mechanical stressing.

EXAMPLE 12

50 g of flock of nylon-6 fibres having a length of 2 mm and a denier of 20 dtex are introduced into a solution of 2 g of $Zr(SO_4)_2 . 4 H_2O$ and 7.5 g of sodium chloride in 750 ml of water, followed by stirring for 20 minutes at 20°C. 1 g of a non-ionic finish (Bayer's Persoftal FN) in 20 ml of water is then added to the suspension, followed by stirring for another 5 minutes. The flock is filtered off from the aqueous solution. A flock having a surface resistance of $1 \times 10^7$ ohms is obtained after spin-drying and drying out in the same way as in Example 1. The flock shows outstanding free flow properties and favourable springability in an electrostatic field.

EXAMPLE 13

50 g of nylon-6 fibres having a length of 0.8 mm and a denier of 1.6 dtex are introduced into a solution of 2 g of $Zr\ OCl_2$ in 750 ml of water with a temperature of 20°C, followed by stirring for 20 minutes at that temperature. A solution of 3 g of the sodium salt of lauryl alcohol $(CH_2CH_2O)_4$ sulphate and 5 g of sodium chloride is then added. After stirring for another 20 minutes, the flock is filtered off from the aqueous solution and dried in the same way as described above. After conditioning, the flock has a surface resistance of $3 \times 10^7$ ohms and shows outstanding free flow properties.

What we claim is:

1. Synthetic fiber flock selected from the group consisting of viscose-, polyacrylonitrile-, polyester-, and polyamide fibers, containing a mineral tanning agent selected from the group consisting of zirconium sulfate, $Zr(OH)_2SO_4+SiO_2.H_2O+Na_2SO_4$ and $ZrOCL_2$.

2. The flock as claimed in claim 1, in which said mineral tanning agent comprises $Zr(OH)_2SO_4 + SiO_2 . H_2O + Na_2SO_4$ .

3. The flock as claimed in claim 2, in which said mineral tanning agent further contains aluminium sulphate and basic chromium sulphate.

4. The flock as claimed in claim 1, in which said mineral tanning agent is $ZrOCl_2$.

5. The flock as claimed in claim 1, in which said mineral tanning agent is zirconium sulphate.

* * * * *